United States Patent [19]

Scholes

[11] 4,289,504

[45] Sep. 15, 1981

[54] MODULAR GAS CLEANER AND METHOD

[75] Inventor: Addison B. Scholes, Muncie, Ind.

[73] Assignee: Ball Corporation, Muncie, Ind.

[21] Appl. No.: 103,433

[22] Filed: Dec. 14, 1979

Related U.S. Application Data

[63] Continuation of Ser. No. 914,448, Jun. 12, 1978, abandoned.

[51] Int. Cl.[3] ..... B03C 3/00

[52] U.S. Cl. ..... 55/11; 55/128; 55/135; 55/136; 55/151

[58] Field of Search ..... 55/11, 133, 128, 135, 55/136–138, 151

[56] References Cited

U.S. PATENT DOCUMENTS

| | | | |
|---|---|---|---|
| 1,393,712 | 10/1921 | Steere et al. | 55/11 |
| 1,790,961 | 2/1931 | Welch | 55/128 |
| 1,826,428 | 10/1931 | Miller | 55/135 |
| 2,215,807 | 9/1940 | Derry | 55/135 |

FOREIGN PATENT DOCUMENTS

| | | | |
|---|---|---|---|
| 561510 | 10/1932 | Fed. Rep. of Germany | 55/128 |
| 1902529 | 8/1970 | Fed. Rep. of Germany | 55/135 |

*Primary Examiner*—Bernard Nozick

*Attorney, Agent, or Firm*—Jenkins, Coffey, Hyland, Badger & Conard

[57] ABSTRACT

A modular gas cleaner can consist of an elongated box having an inlet opening and an outlet opening. The interior of the elongated box is divided into a plurality of elongated passageways by partitioning means within the box. The internal partitions of the box define a plurality of openings so that gas introduced into the inlet opening of the box must travel the length of each passageway prior to passage out of the outlet opening. Electrodes are located within each passageway and electrically isolated from the box to permit the electrodes to be charged to high voltage. The plurality of electrodes are connected with a high voltage supply to create an electrostatic charging and depositing field within the passageways of the box. The gascleaner drain openings provided in the internal partitions which lead to a collecting tank at the low point of the elongated box. Electrical heating means is provided on the outer surface of the box and thermal insulating means surrounds the box and the heating means in order to maintain the fluidity of normally non-fluid material removed from the gas.

6 Claims, 3 Drawing Figures

MODULAR GAS CLEANER AND METHOD

This is a continuation of application Ser. No. 914,448 filed June 12, 1978 now abandoned.

This invention relates to a modular gas cleaner and particularly to an electrostatic gas cleaner which is compact and may be used with other industrial apparatus to remove particulate matter from their exhaust.

The general concept of electrostatic gas filters having collecting chambers and electrodes suspended within the chambers is known. Examples of prior electrostatic gas cleaners are disclosed in U.S. Pat. No. 3,482,375; U.S. Pat. No. 3,668,836 and U.S. Pat. No. 3,826,063.

U.S. Pat. No. 3,482,375 is directed to an electrostatic air filter formed from a plurality of parallel collecting electrodes in the form of corrugated plates having their troughs and ridges substantially vertical and transverse to the flow of gas to be filtered. The plurality of collecting electrodes in the form of corrugated plates are positioned with respect to each other to provide widened spaces in which rod shaped electrodes are centrally located and to form flow paths of narrow cross section intermediate the widened spaces. The gas to be cleaned flows transversely of the length of the vertical widened spaces to obtain low flow rates within the widened space where deposition of the particles carried by the gas is obtained.

U.S. Pat. No. 3,668,836 discloses an electrostatic precipitator in which gas to be cleaned passes longitudinally through a duct or passage of large diameter. The duct encompasses a plurality of perforated plates transversely disposed in the duct, each perforated plate being succeeded by alternate juxtaposed transverse banks of parallel spaced-apart wires. In the apparatus the plates are grounded and the wires are provided with an electrostatic charge so that particles entrained in the gas are deposited from the gas stream onto the plates. U.S. Pat. No. 3,668,836 discloses that the provision of the first plate, prior to the electrodes, is highly advantageous since a considerable portion of the particles will deposit on the first plate, upstream of the initial bank of wires, improving the overall efficiency in removal of particles from the gas stream, and further discloses that such apparatus is usable with liquid particles as well as solid particles. Where the removed particles are liquid, continuous draining of the deposited liquid from the collector plates under the influence of gravity is disclosed to remove the deposited material.

U.S. Pat. No. 3,820,263 is directed to an electrostatic agglomeration apparatus for an air filtering and conditioning system. The disclosed apparatus includes pairs of elongated chambers encompassing centrally located ionizing rods charged to voltages of approximately 10,000 to 40,000 volts. The apparatus divides the gas carrying the particulate matter into two flow paths, one of which provides positive charges to the particulate matter in one of the pair of chambers and the other of which provides negative charges to the particulate matter in the other of the pair of chambers. Upon recombination of the flow paths the oppositely charged particulate matter is agglomerated and conventionally filtered downstream.

U.S. Pat. Nos. 3,919,391 and 3,967,939 relate to method and apparatus for removing exhaust treatment gases containing suspended particles. The method and apparatus include, in addition to other steps, means for imparting an electrostatic charge to materials carried in the exhaust treatment gases. The particular apparatus shown has a circular column which is provided centrally with an electrode and through which materials and gases are drawn. Particles carried by the gases through the circular column are charged and drawn to the walls where they are washed away by a thin descending liquid film.

In contrast to the disclosures of these prior patents, this invention provides a compact electrostatic cleaner that may be added to existing industrial processing apparatus and can be particularly adapted to the removal in fluid form of normally non-fluid particulate material.

The invention uses means forming a plurality of elongated passageways, each passageway having a small cross-sectional area. The passageways are grouped together and adapted to form a labyrinth in which gas to be cleaned, flows the length of each passageway, one after the other, between the time it enters the cleaner and the time it leaves the cleaner. Each passageway encompasses an electrode means connected with a source of voltage to create an electrostatic field within each passageway of sufficient strength to charge and deposit particulate materials carried by the gases on the walls of the passageway.

Means to heat the plurality of passageways may be provided to assist in the charging and collection of normally non-fluid particulate matter. With the means forming the passageways so heated, many normally non-fluid materials collected within the passageways can be melted and provided with sufficient fluidity to be continuously removed from each passageway by gravity.

Thus, the invention can provide a modular air cleaner comprising means forming a plurality of elongated passageways communicating one with the other, so that gas introduced into the inlet of the cleaner must travel longitudinally of each elongated passageway prior to passage through the outlet of the cleaner and thus be exposed to an electrostatic charging and depositing field within each passageway created by electrodes within the passageway. In a particularly preferred embodiment, heating means maintains an elevated temperature within the passageways and the means forming the plurality of passageways is so oriented that fluid material deposited on the walls of the passageway will flow by gravity to drains provided in each passageway for collection within the modular electrostatic cleaner.

Further features and advantages will be apparent from the description and drawings which follow:

Many industrial processes and apparatus produce airborne particulate matter which should be collected in such a manner that it can be readily disposed of without contamination of the industrial plant or environment. Among such processes, for example, is a provision of lubricating material to metal sheet and strip. In the production of metal cans, it is often necessary to provide slight amounts of lubrication material on the surface of a metal sheet or strip before subjecting the metal stock to further forming operations, such as passing the stock through various forming dies. Metal stock is, therefore, provided with particulate coatings of lubricating materials which frequently include lubricating materials which are non-fluid at room temperature.

In providing metal sheets with such lubrication, it is frequently not possible to deposit all the particles of lubricating material onto the metal sheets. Many such particles are frequently carried from the lubricating apparatus. It is advisable that such lubricating material, which can include materials such as oils and waxes, be collected prior to escape into the plant atmosphere. A modular gas cleaner of this invention may be easily and conveniently added to such processes and apparatus, and to other processes and apparatus in which particulate contaminates may otherwise be carried into the atmosphere, to remove particulate material carried in their exhaust gases for disposal without contamination of the atmosphere.

Figure 1:
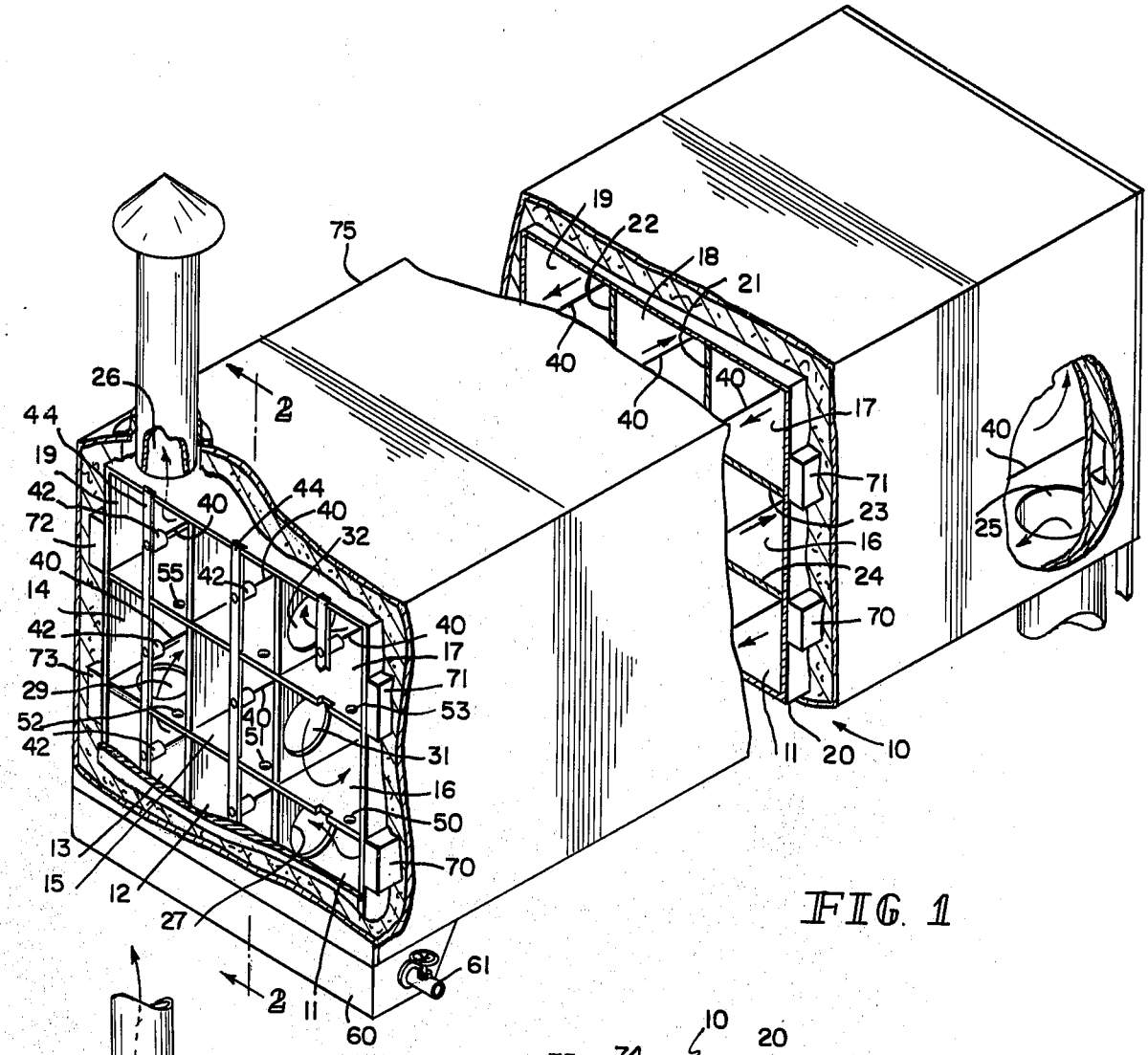
FIG. 1 is a partial perspective view of an apparatus of this invention.

Referring now to the drawings, and particularly FIG. 1, an apparatus embodying this invention is illustrated. Such an apparatus includes means 10 forming a plurality of elongated passageways 11 through 19. The means illustrated is formed by an elongated metal box 20, including a plurality of partitions arranged within the metallic box 20 to form the plurality of passageways 11 through 19. As shown in FIG. 1, nine elongated passageways are formed within the box 20 by two vertical partitions 21 and 22 and two horizontal partitions 23 and 24. The box includes an opening 25 defining an inlet and an opening 26 defining an outlet.

Figure 2:
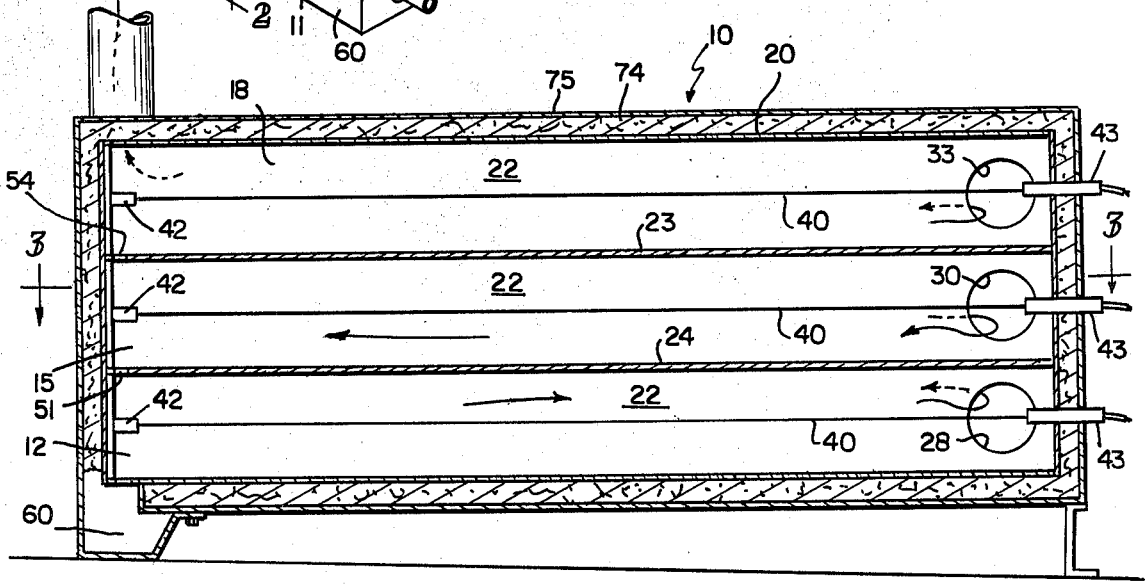
FIG. 2 is a cross-sectional view of the apparatus of FIG. 1 taken along vertical line 2—2 of FIG. 1.
Figure 3:
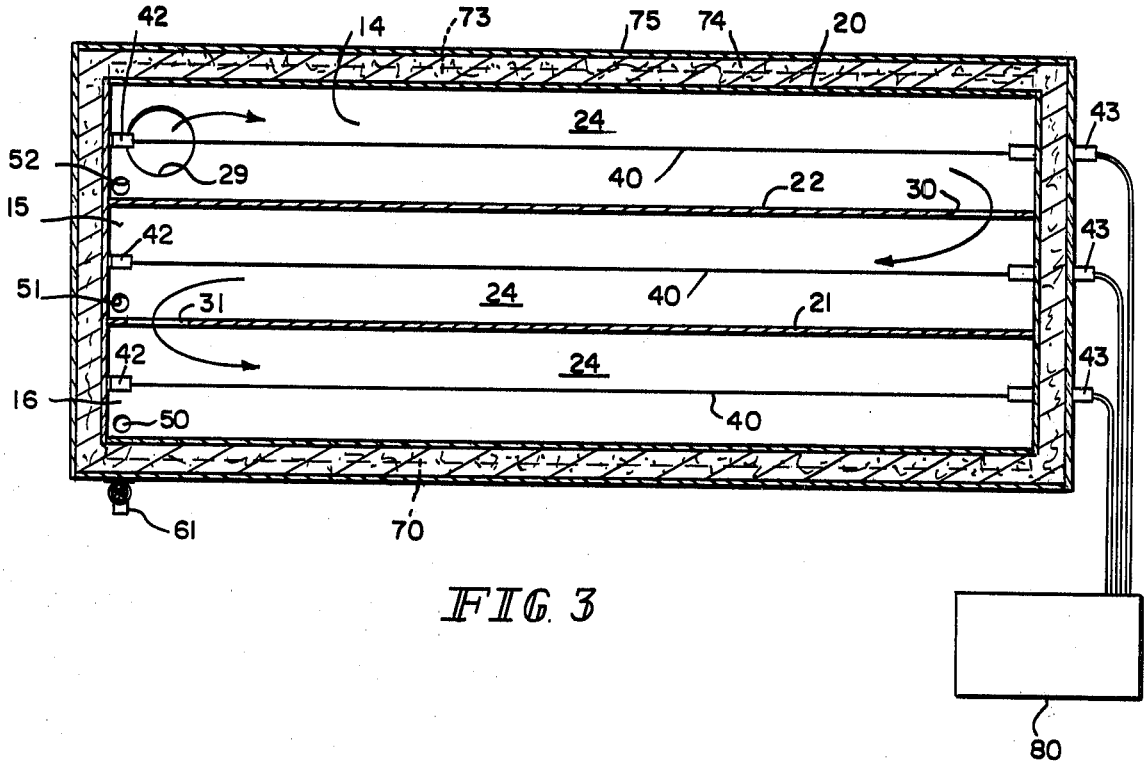
FIG. 3 is a cross-sectional view of the apparatus of FIG. 1 and FIG. 2 taken along the horizontal line 3—3 of FIG. 2.

The internal partitions of box 20 define openings such that gas and particulate materials to be removed from gas that enter the inlet 25 must travel longitudinally and serially through passageways 11 through 19 before reaching the outlet 26. Thus, partition 21 includes an opening 27 at the end of passageway 11 remote from the inlet opening 25 and directing gas into passageway 12 as shown in FIG. 1. As shown in FIG. 2, partition 22 includes an opening 28 at the end of passageway 12 remote from opening 27 and directing gas into passageway 13. As shown in FIG. 1 and FIG. 3, partition 24 includes an opening 29 at the end of passageway 13 remote from opening 28 and directing gas into passageway 14. As shown in FIG. 2, partition 22 has an opening 30 at the end of passageway 14 remote from opening 29 and directing gas into passageway 15. As shown in FIG. 1, partition 21 has an opening 31 at the end of passageway 15 remote from opening 30 and directing gas into passageway 16. At the end of passageway 16 remote from opening 31, partition 23 includes an opening (not shown) directing gas to flow from passageway 16 into passageway 17, and at the opposite end of the passageway 17, partition 21 has an opening 32, as shown in FIG. 1, directing gas to flow from passageway 17 into passageway 18. At the end of passageway 18 remote from opening 32, partition 22 has an opening 33 directing gas into passageway 19, and outlet 26 is at the end of passageway 19 remote from opening 33.

As shown in FIGS. 1, 2 and 3, each passageway 11 through 19 encompasses a wire-like electrode 40 running the length of the passageway and preferably centrally located within the passageway. The plurality of electrodes 40 in the embodiment illustrated are steel music wire having a diameter of 0.009 inches. The plurality of electrodes 40 are electrically isolated from the metal box 20 and supported centrally within each of the passageways by standoff insulators 42. The standoff insulators 42 may be any material which is not electrically conductive in the presence of high d.c. voltages. Such materials include nylon, polyethelyne, polypropolyene and most ceramic materials. As shown in FIG. 1, the plurality of standoff insulators 42 are supported from supporting structures 44 which may be also made of electrically nonconductive material. At the other end of the elongated box 20, each of the plurality of electrodes terminates within a tubular bushing 43 that passes through the metallic wall of the apparatus 10. The plurality of tubular bushings 43 not only support the electrodes 40 centrally within each of passageways 11 through 19, but electrically isolate the high-voltage connections to each of the plurality of electrodes 40 from the grounded conductive portions of the apparatus 10. As shown in FIG. 2 and FIG. 3, a plurality of high-voltage electric cables interconnect each of the electrodes 40 with a source of high d.c. voltage.

In the apparatus shown, the metal box 20 has dimensions of approximately 12 inches vertically and 12 inches horizontally and a length of approximately 3 feet. Each of the passageways formed by partitions 21 through 24 has a cross-sectional area of 4 inches by 4 inches. The 0.009 inch diameter electrode is supported at the geometric center of each of the passageways and is charged to a voltage on the order of 20,000 volts d.c., creating within each of passageway 11 through 19 an electrostatic field with electrode 40 as one terminus and the means forming the walls of the passageways as the other terminus. Electrical ions are formed within the passageways by the electrostatic field and travel in response to the electrostatic field generally transversely between the electrodes 40 and the walls of the passageway. The gas and particulate material that it carries, in its travel longitudinally and serially through passageways 11 through 19, must pass through the successive and repeated ion bombbardment created by the electrostatic fields within each of the plurality of passageways. Particulate material carried by said gas becomes charged by the ion bombardment and urged under the influence of electrostatic field to the walls of the passageways 11 through 19. Such particulate matter is thus removed from the gas entering inlet 25 and collected on the walls of the metal box 20 prior to reaching the outlet 26.

Although the embodiment shown comprises a metal box with partitions forming the plurality of passageways, other means forming elongated passageways may be used. For example, such means may be formed by a plurality of rectangular or round tubes bundled together and interconnected to provide a labyrinth through which the gas must flow. Such tubes can be interconnected so that the gas must travel the length of each passageway in series between an inlet to such means and an outlet from such means. In addition, the cross-sectional area and dimensions of the passageways, the electrode size, and the voltage imposed upon between the electrode and the means forming the passageways may be varied from that disclosed above. The cross-sectional area of the passageway is dependent, in part, on the rate of material removal to be accomplished by the cleaner, and the amount of material to be collected between servicing of the cleaner. The cross-sectional area of the passageway, electrode size and voltage should be such that the ions created within the passageway provide a significant electric current on the order of 10 to 20 microamperes per foot of passageway length flowing between the electrodes and the walls of the passageway. The voltage to create such ionization is in the order of 5 to 10 kilovolts for each inch of spacing between the charged electrode and the grounded electrode, but care should be taken to select a combination of spacing and voltage at which such ionization can occur without sparking.

Where fluid materials are to be collected, the means 10 should be oriented so that fluid materials collected on the walls of the passageway will flow under the influence of gravity to one end of the apparatus. As shown in FIG. 2, the means 10 is supported so that it is somewhat higher adjacent the inlet than it is adjacent the outlet. Thus, fluid materials collected upon the walls of the passageway will flow to the left as shown in FIG. 2. Each of the horizontal partitions, 23 and 24, are provided with drain holes 50, 51, 52, 53, 54 and 55 as shown in FIG. 1 and FIG. 2. Thus, fluid reaching the lower end of each of passageways 17, 18 and 19 can flow through openings 53 through 55 into passageways 14, 15 and 16 and fluid in passageways 14, 15 and 16 can flow through drain openings 50 through 52 into passageways 11, 12 and 13. Drain holes, not shown, are provided in the metal box 20 at the bottom of passageways 11 through 13 to permit fluid material in passageways 11 through 13 to flow under the influence of gravity into a collection container 60 (shown in FIGS. 1 and 2). Means 61 is provided to drain the container 60.

Where the gas to be cleaned includes a normally non-fluid material such as wax, the apparatus 10 can be provided with heating means such as heaters 70, 71, 72 and 73 attached to the metal box 20, or otherwise in such a relationship to heat the apparatus 10. The temperature of the means forming passageways 11 through 19 can be maintained at such an elevated temperature that wax particles deposited on the walls of the passageways are liquefied and provided with sufficient fluidity to flow into the container 60. Where heating means, such as heaters 70 through 73, are used, the apparatus 10 is surrounded with thermal insulation 74, such as fiberglas, and an outer protective structure 75.

Apparatus, such as that described, can provide a small compact structure that can be added to and used with many industrial methods and processes to remove airborne particulate matter generated in the use of such methods and processes. Such apparatus can remove unwanted particulate matter and provide a flow of clean gas to the environment or industrial plant.

The preferred embodiment illustrated and described is capable of many modifications without departing from the spirit and scope of my invention as set forth in the following claims.

I claim:

1. A method of removing wax-like particulate matter from a gas comprising:

introducing a gas with wax-like particulate matter to be removed into an inlet opening of a modular gas cleaner, serially transporting all introduced gas to and fro through each passageway of a labyrinth comprising a plurality of generally horizontal passageways formed within the modular gas cleaner, each passageway having a small cross-sectional area and being formed by a plurality of electrically conductive partitions and including an opening at each end to force the introduced gas and particulate-like material into abrupt changes in direction in its to and fro transportation;

creating an electrostatic field and electrostatic forces between the electrically conductive partitions and electrodes centrally located within each passageway, said electrostatic field and electrostatic forces being generally transverse to the direction of gas flow and at least in part acting in the same direction as gravity, said electrostatic field having sufficient intensity to create ionization centrally of the flow path and to expose the gas and wax-like particulate matter being transported to ion bombardment within each passageway prior to passage through an outlet opening of the modular gas cleaner; and heating the flow path to assist in charging, deposition, and collection of the wax-like particulate matter and to place the wax-like matter in a fluid state so that it may be drained from within the modular gas cleaner by gravity through drain holes formed in the partitions of the gas cleaner.

2. A modular gas cleaner comprising:

an elongated metal box having an inlet opening and an outlet opening;

a plurality of metallic partitions within the box and dividing its interior into a plurality of elongated generally horizontal passageways including at least two vertical partitions and at least two horizontal partitions, said partitions defining a plurality of openings so that gas introduced into the inlet opening must travel longitudinally through each passageway, one after the other, before reaching the outlet opening;

a plurality of electrodes located within each passageway and electrically isolated from the metal box and partitions to permit the electrodes to be charged to high voltage;

a high voltage supply connected to said electrodes and to said box to create an electrostatic charging and depositing electrostatic field within each passageway; and electrical heating means attached to the outer surface of the metal box and thermal insulating means surrounding said box and said heating means, said partitions providing flow paths for draining fluid material from within the metal box.

3. A modular gas cleaner comprising:

an elongated generally horizontal box having an inlet opening and an outlet opening;

a plurality of electrically conductive partitions within the box and dividing its interior into a plurality of elongated generally horizontal passageways, said partitions defining a plurality of openings so that all gas introduced into the inlet opening must travel longitudinally and serially through each individual passageway, one after the other, prior to passage through the outlet opening;

a plurality of wire electrodes centrally located within each passageway and electrically isolated from the elongated box to permit the wire electrodes to be charged to high voltage;

a high voltage supply connected to said plurality of wire electrodes and to said box to create an electrostatic charging and depositing electrostatic field within each passageway, all of the gas being subjected to the electrostatic field within each passageway prior to passage through the outlet opening; and means for heating the metal box and its interior, said partitions forming passageways, providing flow paths for draining fluid material from within the metal box.

4. A modular gas cleaner comprising:

an elongated box having an inlet opening and an outlet opening with a collecting tank at its bottom;

a plurality of electrically and thermally conductive partitions within the box and dividing its interior into a plurality of elongated passageways, said partitions defining a plurality of openings so that gas introduced into the inlet opening must travel longitudinally through each passageway, one after the other, between the inlet opening and the outlet opening, said partitions further providing a plurality of drain holes permitting fluid flow under the influence of gravity from the passageways to the collecting tank;

a plurality of wires centrally located within each passageway and electrically isolated from the elongated box to permit the wires to be charged to high voltage;

a high voltage supply connected to said plurality of wires and to said box to create an electrostatic charging and depositing electrostatic field within each passageway; and electrical heaters attached to the outer surface of the box with thermal insulating means surrounding said box and said electrical heaters.

5. A modular gas cleaner comprising:

box-like means forming a plurality of elongated passageways sharing common walls, each passageway having a small cross-sectional area and being connected together to form a labyrinth in which all gas to be cleaned of particles must flow the length of each passageway, serially one after the other, between the time it enters the cleaner and the time it leaves the cleaner;

an electrode means within each passageway and connected with a source of voltage to create an electrostatic field within each passageway of sufficient strength to charge and deposit particulate materials carried by the gases on the walls of the passageways, all of the gas to be cleaned being subjected to the electrostatic field within each passageway, said walls having openings to force said particles into abrupt changes in direction adjacent to said electrode means; and means to heat the walls of the plurality of passageways, and wherein the walls forming the passageways are provided with drain holes so that fluid materials collected within the passageways can be continuously removed from each passageway by gravity.

6. A modular gas cleaner comprising:

an elongated metal box having an inlet opening and an outlet opening;

a plurality of metallic partitions within the box and dividing its interior into a plurality of elongated generally horizontal passageways, including a set of angularly related partitions to provide generally horizontal flow paths for the gas and for draining fluid material from within the metal box, said partitions defining a plurality of openings so that gas introduced into the inlet opening must travel longitudinally through each passageway, one after the other, before reaching the outlet opening, said partitions further defining a plurality of drain holes for fluid material collected within the passageways;

a plurality of electrodes located within each passageway and electrically isolated from the metal box and partitions to permit the electrodes to be charged to high voltage, and a high voltage supply connected to said electrodes and to said box to create an electrostatic charging and depositing electrostatic field within each passageway between the electrodes and the partitions; and electrical heating means attached to the outer surface of the metal box and thermal insulating means surrounding said box and said heating means.

* * * * *

UNITED STATES PATENT AND TRADEMARK OFFICE

CERTIFICATE OF CORRECTION

PATENT NO. : 4,289,504

DATED : September 15, 1981

INVENTOR(S) : Addison B. Scholes

It is certified that error appears in the above-identified patent and that said Letters Patent are hereby corrected as shown below:

Cancel the ABSTRACT and rewrite as follows:

A gas cleaner can be provided to remove particulate matter, including particles of fluid, from gas exhausted from other apparatus. Such a modular gas cleaner can consist of an elongated box having an inlet opening and an outlet opening. The interior of the elongated box is divided into a plurality of elongated passageways by partitioning means within the box. The internal partitions of the box define a plurality of openings so that gas introduced into the inlet opening of the box must travel the length of each passageway prior to passage out of the outlet opening. Electrodes are located within each passageway and electrically isolated from the box to permit the electrodes to be charged to high voltage. The plurality of electrodes are connected with a high voltage supply to create an electrostatic charging and depositing field within the passageways of the box. Gas to be cleaned is directed to the inlet opening and travels through the labyrinth of passageways within the box. During such travel, particulate matter carried by the gas is charged and deposited on the walls of the passageways. Fluid material can flow to the low point of each passageway and through drain

UNITED STATES PATENT AND TRADEMARK OFFICE

CERTIFICATE OF CORRECTION

PATENT NO. : 4,289,504

DATED : September 15, 1981

INVENTOR(S) : Addison B. Scholes

It is certified that error appears in the above-identified patent and that said Letters Patent are hereby corrected as shown below:

openings provided in the internal partitions to a collecting tank at the low point of the elongated box. Electrical heating means can be provided to the outer surface of the box and thermal insulating means can surround the box and the heating means in order to maintain the fluidity of normally non-fluid material removed from the gas.

Column 4, line 24, delete "passageway" and substitute therefor --passageways--.

Column 6, line 63 (claim 3, line 24) delete "," (the comma).

Signed and Sealed this

First Day of December 1981

[SEAL]

Attest:

GERALD J. MOSSINGHOFF

Attesting Officer

Commissioner of Patents and Trademarks